US007963505B2

(12) United States Patent
Taylor et al.

(10) Patent No.: US 7,963,505 B2
(45) Date of Patent: Jun. 21, 2011

(54) SELF-CONTAINED SELF-ELEVATING PLATFORM LIFT

(76) Inventors: James E. Taylor, Midlothian, TX (US); Tommy W. Taylor, Dallas, TX (US)

( * ) Notice: Subject to any disclaimer, the term of this patent is extended or adjusted under 35 U.S.C. 154(b) by 0 days.

(21) Appl. No.: 12/549,187

(22) Filed: Aug. 27, 2009

(65) Prior Publication Data

US 2010/0051888 A1 Mar. 4, 2010

Related U.S. Application Data

(60) Provisional application No. 61/190,329, filed on Aug. 28, 2008.

(51) Int. Cl.
*B66D 1/36* (2006.01)

(52) U.S. Cl. ..... 254/286; 254/278; 187/259; 187/262; 248/343; 248/329; 182/150; 182/144

(58) Field of Classification Search ..... 254/266, 254/278, 283, 286; 287/259, 261, 262, 148, 287/144; 248/327, 329, 343; 182/141, 142, 182/144, 150

See application file for complete search history.

(56) References Cited

U.S. PATENT DOCUMENTS

| | | | | |
|---|---|---|---|---|
| 364,863 | A | 6/1887 | Kavanaugh, Jr. | |
| 651,236 | A * | 6/1900 | Corcoran | 187/250 |
| 1,636,474 | A | 11/1926 | Lavallee | |
| 1,867,568 | A | 3/1928 | Hirshfeld | |
| 2,242,892 | A | 5/1941 | Light | |
| 2,420,903 | A | 10/1945 | Noble | |
| 2,499,791 | A | 8/1946 | Spencer | |
| 3,516,559 | A | 6/1970 | Walter | |
| 3,565,217 | A | 2/1971 | St. Louis | |
| 3,576,233 | A | 4/1971 | Thatcher | |
| 3,661,415 | A | 5/1972 | Piasecki | |
| 3,729,245 | A | 4/1973 | Skifstrom | |
| 3,743,287 | A | 7/1973 | Liermann | |
| 3,814,211 | A * | 6/1974 | Pamer | 182/14 |
| 4,000,789 | A * | 1/1977 | Zahner | 182/152 |
| 4,091,906 | A | 5/1978 | Clarke et al. | |
| 4,412,601 | A | 11/1983 | Cooper | |
| 5,044,473 | A | 9/1991 | Gripe | |
| 5,082,085 | A | 1/1992 | Ream et al. | |
| 5,199,843 | A | 4/1993 | Sferra | |
| 5,203,619 | A | 4/1993 | Welsch et al. | |
| 5,205,379 | A | 4/1993 | Pfleger | |
| 5,261,645 | A | 11/1993 | Huffman | |
| 5,370,206 | A | 12/1994 | Chao | |

(Continued)

*Primary Examiner* — Emmanuel M Marcelo
(74) *Attorney, Agent, or Firm* — John F. Booth; Booth Albanesi & Schroeder LLC

(57) ABSTRACT

In one embodiment, a self-elevating platform lift for moving objects between a first level and a vertically-elevated second level is provided. The platform lift comprises: (A) a platform for supporting the objects; (B) a plurality of lift lines for connection at the second level and for moving the platform; and (C) a motor connected to move with the platform and wherein the motor operably is connected to the lift lines for moving the platform between the first and second levels while being supported by the lift lines. In another embodiment, a lift installation is provided for moving objects between a first level and a vertically-elevated second level comprising: (A) a platform for supporting the objects; (B) a plurality of lift lines fixed at one end to extend downward from the second level for moving the platform; and (C) a motor connected to move with the platform and wherein the motor operably is connected to the lift lines for use in moving the platform between the first and second levels while being supported by the lift lines.

48 Claims, 14 Drawing Sheets

U.S. PATENT DOCUMENTS 5,535,852 A 7/1996 Bishop et al.
5,667,035 A 9/1997 Hughes
5,772,360 A 6/1998 Wood, II
5,871,070 A 2/1999 Contreras
5,927,440 A * 7/1999 Freeman ..... 187/270
6,123,495 A 9/2000 Callahan et al.
6,131,702 A 10/2000 Berridge
6,161,702 A 12/2000 Campbell
6,241,048 B1 6/2001 Heilmann
6,386,515 B1 * 5/2002 Sachtleben ..... 254/338
6,478,530 B2 * 11/2002 Patrito ..... 414/678
6,637,711 B2 * 10/2003 Enochs ..... 248/327
6,676,233 B1 1/2004 Evans et al.
6,779,634 B1 8/2004 Slagle
6,860,367 B1 3/2005 Ericson
6,962,236 B2 11/2005 Penn
6,991,064 B2 1/2006 Ehrenleitner
7,080,806 B2 7/2006 Mills
7,168,371 B1 1/2007 Ruff
7,195,106 B2 3/2007 Heynssens
7,225,902 B2 6/2007 Hashiguchi
7,228,939 B1 6/2007 Prater
7,284,744 B1 10/2007 Lerchenmueller et al.
7,325,785 B2 2/2008 Krengel et al.
7,334,776 B2 * 2/2008 Kazerooni ..... 254/270
7,357,223 B2 4/2008 Penn
7,410,150 B1 * 8/2008 Falls ..... 254/272
7,416,055 B2 8/2008 Penn et al.
7,523,919 B2 * 4/2009 Hanlon ..... 254/278
7,527,242 B2 5/2009 Shaha
2002/0185637 A1 * 12/2002 Enochs ..... 254/266
2004/0144594 A1 * 7/2004 Cunniffe ..... 182/142
2006/0000675 A1 1/2006 Penn et al.
2007/0114098 A1 5/2007 Hartley
2007/0240347 A1 * 10/2007 Chang ..... 40/601
2008/0203046 A1 8/2008 Friesen et al.
2008/0296089 A1 * 12/2008 Penn et al. ..... 182/142
2009/0110528 A1 * 4/2009 Walter et al. ..... 414/609
2009/0178883 A1 * 7/2009 Castle ..... 182/19
2010/0051888 A1 * 3/2010 Taylor et al. ..... 254/286

* cited by examiner

| NO. | QTY. | DESCRIPTION | PART NUMBERS |
|---|---|---|---|
| 324 | 1 | DC Motor-115v FWR-2 Poles 1600RPM | ⊛ |
| 314 | 1 | Switch, 3PDT, ON-OFF-ON (Toggle) | 683-0073 |
| 315 | 2 | Switch, Push Button, Sub Min. | 870-0471 |
| 316' | 1 | Switch, Cap-Red | 870-3000 |
| 316 | 1 | Switch, Cap-Black | 870-4000 |
| 319 | 1 | Relay, 25A(Max.), 100/120 VAC | 821-7020 |
| 313 | 3 | Gland, Cable | 500-0216 |
| 312 | 3 | Nut, Lock | 500-7212 |
| 311 | 1 | Enclosure, Polystrene | 500-0569 |
| 325<br>325' | 2 | Switch, Gen. Purpose<br>15A, Hinge Lever | 821-0036 |
| 317 | 1 | Indicator, Green | 679-0138 |

PARTS LIST

Note:
✳ Allied Electronics Inc. is in Ft. Worth, TX
⊛ Groschopp, Inc. is in Sioux Center, IA ⊛ Groschopp - PM 8018, w/Gear Reducer RA5060M (60:1) Ratio, 141/41461 & w/120v AC to DC Rectifier, 318

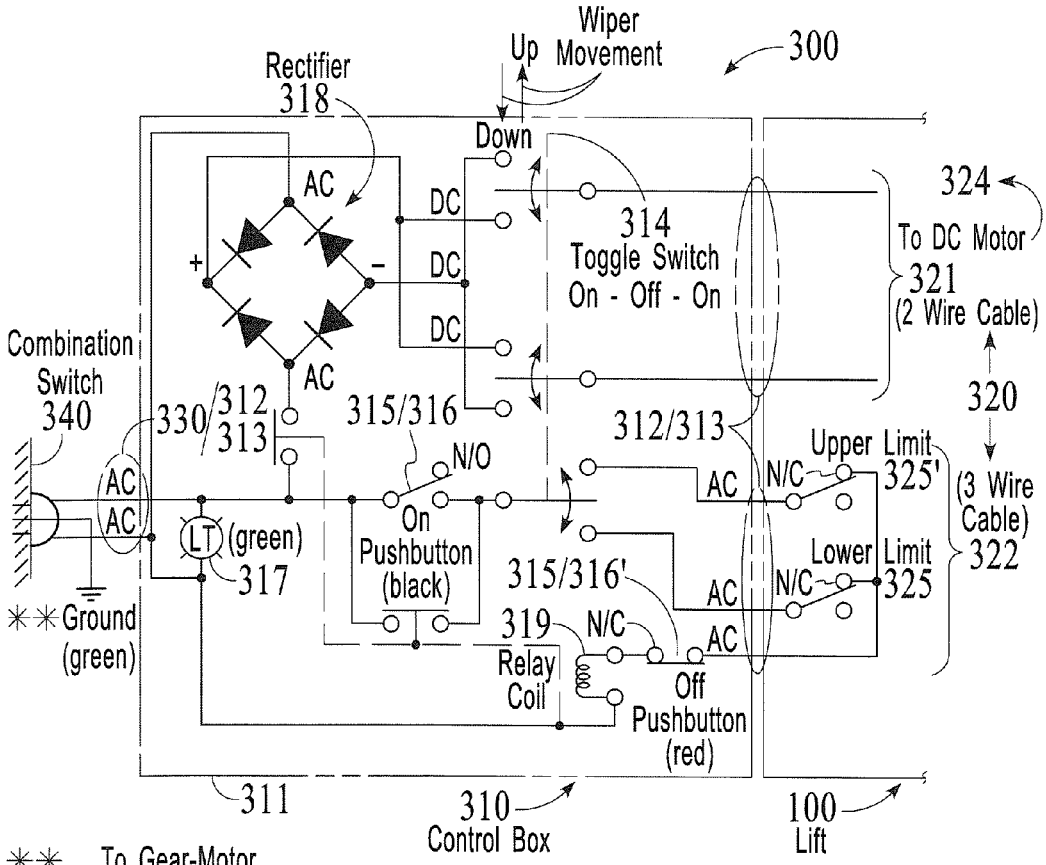

✳✳ To Gear-Motor
N/O = Normally Open
N/C = Normally Closed

FIG.21

SELF-CONTAINED SELF-ELEVATING PLATFORM LIFT

CROSS-REFERENCE TO RELATED APPLICATIONS

This application claims the priority of U.S. Provisional Patent Application Ser. No. 61/190,329, filed Aug. 28, 2008

FIELD OF INVENTION

The field of the invention is directed to a self-contained, self-elevating platform for lifting objects to and from an elevated area.

BACKGROUND OF THE INVENTION

Houses often contain an attic in which to store personal belongings. An attic is normally accessed via a set of stairs. In order to place objects in the attic, a person must pull on a cord or rope, which is attached to the set of stairs, and then navigate up the stairs with a box or objects in hand. This can be quite dangerous. Often times, the objects are too heavy for a single person to carry the objects up the set of stairs. Similar problems exist for other areas in which to store personal items. For example, a garage or shed can contain a similar storage area which has an upper floor space and a set of stairs.

Therefore, there is a need to provide a simple platform lift that objects can be placed on, which is self-elevating, such that the objects can be lifted into or removed from the space without the need for carrying the objects up a set of stairs.

SUMMARY OF THE INVENTION

A self-contained self-elevating attic type lift system includes a module comprising a platform for supporting objects to be transported and an enclosure attached to and beneath the platform. The enclosure comprises a bottom and four side walls which form a box. The enclosure houses a complete compact electromechanical power mechanism to provide the force necessary to lift and lower the module and the objects. Objects are lifted to and from attics, or similar storage areas, utilizing a pre-established opening in the floor of the attic or the storage areas. The module is supported by lift lines which can comprise elongated flexible tensioners. The flexible tensioners are strong enough to provide support for the platform, while being flexible enough to spool or unspool around a centralized shaft. Suitable examples of elongated flexible tensioners include chains, straps, ropes, and cables. When the module is in a raised position and reaches its upper limit, the upper surface of the platform is level with, or extends slightly above, the floor of the attic or storage area. The inside surface of the bottom of the enclosure is substantially level with the ceiling of the hallway, room, or garage. Thus, the platform and enclosure forming the module basically appears to become an integral part of the attic floor and ceiling within the cutout opening. Nothing is required to be installed permanently above the floor and nothing, except the moveable module, occupies the cutout opening in the floor. When the module is lowered below the ceiling, only the lift lines and their end attachments at the attic floor remain in the opening. Tapered guides attached to the sides of the enclosure guide the module up into the opening of the floor. The guides center the module within the sides of the opening. The shape of the module is preferably rectangular, and sized in width to normally coincide with joist spacings of the floor/ceiling area. Headers located between the attic joists determine the length of the floor opening and, therefore, the length of the rectangular module's platform.

The ceiling opening is preferably made in close proximity to a standard fold-down garage stairway or near a standard stairway for other than garage installation. Alternatively, a conventional garage stairway might be removed, leaving an elongated rectangular opening in the ceiling. In this example, a header is installed mid-span of the opening leaving two square openings. One opening can be used for installation of the lift; and the other opening can be used for climbing up and down a portable, safe, and properly designed ladder, which can be hooked to an attic joist.

All of the self-contained electromechanical power lifting mechanism, including a single rotating shaft with lift lines and sheaves, is compactly and completely installed within the enclosure.

The particular gear-reducer selected is a low-speed, high-torque (high-ratio) "worm" gear type which is coupled to a high-speed, low-torque electric motor, producing a gear-motor combination, which is compact and efficient. The gear-motor combination provides two important features and benefits: it is "self-locking" when power is OFF, i.e., it cannot be rotated; and dangerous "free-wheeling" is eliminated. Because it is not "free-wheeling," there is no need for a brake. The gear of the worm-gear reducer is keyed to a single continuous drive shaft. The single continuous drive shaft goes through the reducer and supports four cable sheaves, which are mounted adjustably thereon and locked to take in or feed out the lift's cables as the shaft rotates. A gear motor reducer is generally centrally mounted firmly to, and is supported by and within, the enclosure. Since two of the lift lines pull horizontally in one direction and the other two pull substantially horizontally in the opposite direction, the lift line loads cancel each other, such that the reducer experiences only torsion. This torsion is reacted by minor differences in the loads on each of the two pairs of lift lines at opposite ends of the enclosure. Loads will reverse when the direction of the travel of the lift is reversed. Each pair of lift lines are then directed around a corresponding pair of pulleys at each end of the enclosure and vertically upward to the floor above the opening.

The enclosure can be accessed via the platform. The platform can be removed from the enclosure. By way of another example, the platform can be secured to the enclosure via hinges and, as such, the platform can be raised from the enclosure. By way of yet another example, the platform can be affixed permanently to the enclosure and constructed with an access door or doors. The powered lifting mechanism is, therefore, readily accessible for adjusting, trouble-shooting, or performing certain maintenance functions at ground level.

The lift module is, therefore, self-contained and self-elevating in that the objects to be lifted, as well as the platform and enclosure, including the entire powered lifting mechanism, is intact to support and lift the objects. Numerous advantages can be appreciated when operating, adjusting, trouble-shooting, or maintaining the above-described lift.

The lift module provides a most simple design having a minimum number of parts and, therefore, minimum cost. This is accomplished while still adequately meeting design specifications, i.e., to safely lift objects falling within maximum weight and size limits, within given time frames to and from specific heights. The only items not located in the enclosure are: vertically extending lift lines, two at each end of the enclosure; lift line end supports located at the attic floor; and in one embodiment, a flexible electrical control cable and control box.

An important feature and benefit of this particular design is that the lift line ends extending vertically above and supporting the lift module are easily and quickly installed, or uninstalled, in the attic floor. This eliminates anything being permanently installed and operating in the opening between the joists and headers, or above the floor opening. The result is an efficient, clean, and inexpensive system.

In one embodiment, the module has a battery-powered electrical system for operation of the mechanism providing power to lift module.

In another embodiment, the motor is a direct current (DC) motor. In this manner, a wall-mounted control box is preferably installed adjacent to a pre-existing electrical wall switch, which provides ON-OFF AC power to the light in the attic. This switch is changed to a combination switch which provides one switch for the light and another switch for an electrical outlet for a 115V-AC plug. The combination switch and outlet is wired to existing wiring in the wall such that the switch controls the light and also provides AC power to the box controlling the lift module. This occurs when the AC cable with plug from the control box is inserted into the receptacle of the combination switch. Another longer cord from the control box goes directly to the module providing DC power and ground to the gear-motor, as well as AC power to two limit switches. The control box is pre-wired within the box with a short external cable going to the combination switch, and another longer external flexible cable going to the module, providing up and down travel.

DESCRIPTION OF THE DRAWINGS

The above-discussed and other features and advantages of the present invention will be appreciated by and understood by those of ordinary skill in the art from the following detailed description and Figures in which:

FIG. 21 shows a schematic and purchased parts list of the entire electrical system as designed, manufactured, operated and tested to completion.

DETAILED DESCRIPTION OF PREFERRED EMBODIMENTS OF THE INVENTION

Figure 1:
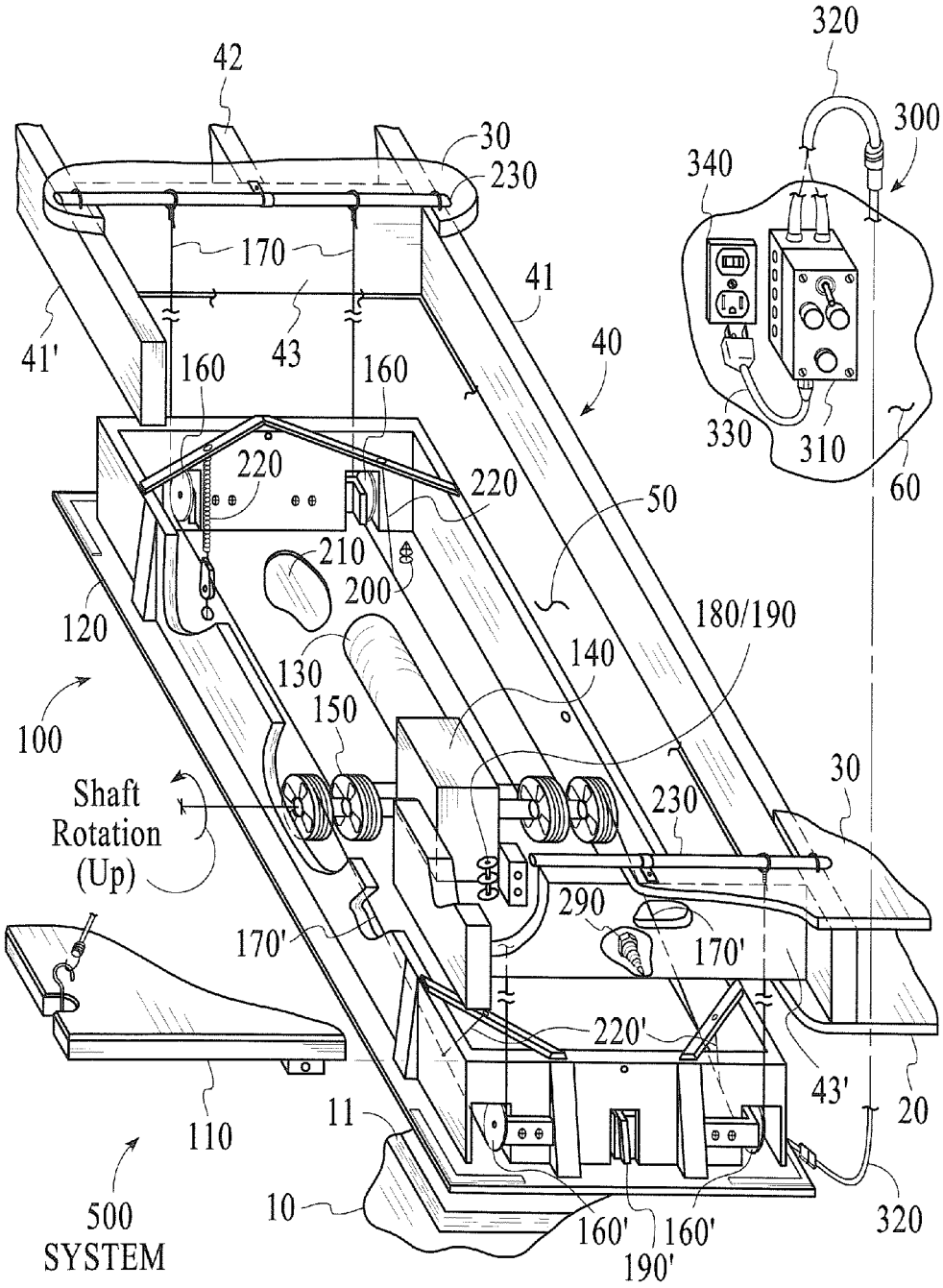
FIG. 1 is an isometric view partially in section illustrating a platform lift module in accordance with a preferred embodiment of the invention, as installed between joists and headers of a typical attic or attic-like space, defining an opening for the lift.

The isometric pictorial drawing of system 500 in FIG. 1 is presented to enable one quickly to view clearly the simplicity of lift module 100, showing a minimum number of parts to achieve the intended purpose of the invention. Module 100 includes platform 110, enclosure 120, and power lifting mechanism 130. Power mechanism 130 consists of gear-motor 140, single shaft and sheaves assembly 150, two pulley installations 160 and 160', two lift line installations (hereinafter referred to as "wire cable installations" 170 and 170'), lower travel limit installation 180 with lower limit switch installation 190, and upper travel limit installation with upper limit switch installation 190' at one end of enclosure 120. Also related to the power lifting mechanism 130 of module 100 is the electrical system 300. It readily can be seen that the entire power lifting mechanism 130 is within the enclosure 120 and is covered by, and below, the platform 110. Therefore, the module 100 is self-contained and self-elevating and allows that nothing of any significance is installed in the opening 50 of the attic. Attached to the enclosure 120 are four spring-loaded plungers 200, as well as other items which are more clearly shown and described in detail in accompanying Figures following.

Shown also in FIG. 1 as part of the attic or garage where the module is to be installed is the floor 10, ceiling 20, and attic floor 30 located above the ceiling 20, frame 40, and frame opening 50. Shown as part of frame 40 are joists 41 and 41', optional cut joists 42 and 42', and header 43 and 43' forming the opening 50.

Figure 1A:
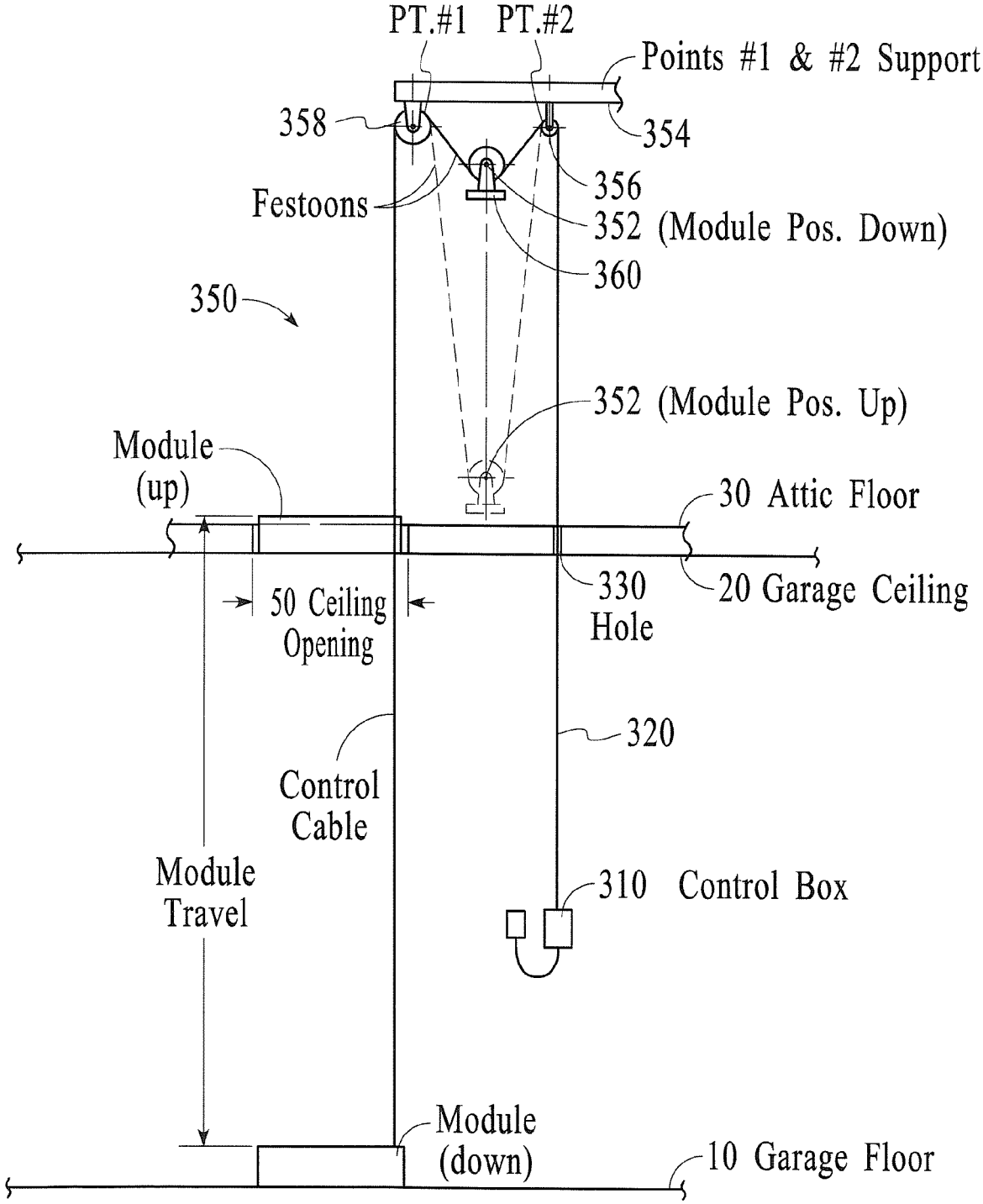
FIG. 1*a* is a diagram of a festoon arrangement for the cable.

FIG. 1 shows the cable 320 going from the control box 310 to the lower part of module 100. The cable 320 must be sufficiently slack and be attached at one point to the garage or attic wall. However, one disadvantage to this arrangement is that the cable will at times be in the operator's way, and will always remain in the garage. An alternative and preferred embodiment would be to have this cable 320 attached to the upper part of one corner of the module and extend therefrom straight up to and through the opening area 50 into the attic above. The cable 320 would remain vertical, straight, and taut as the module ascends from the garage floor 10 and through the opening 50. The other end of the cable attached to the control box 310 would also extend directly vertically up to and through a hole 330 in the ceiling 20 and into the attic above. This continuous cable 320 in the attic would have sufficient length to allow a variable festoon arrangement 350 to take up and feed out the cable as the module ascends and descends from one position to another. The festoon arrangement 350 would be located in the attic, as described below, and presented in FIG. 1*a*. The cable festoon described herein is a variable loop or curve suspended between two points. The two points are stationary, but the length of the cable is allowed to increase and decrease between these points as the module moves up and down. The movement of the module, therefore, causes the cable 320 to be taken up by the festoon when the module moves up, and causes the cable to be fed out as the module moves down. The cable will always be taut and, therefore, cannot tangle during the module's movement. To cause the above to function as described, a large rotatable pulley 358 is suspended from the roof 354, or other means, in the attic. The cable 320 attached to the module is allowed to remain vertical and rotate around this pulley 358, thus, defining one of the two points. The second point of the festoon is also suspended from the roof 354, or other means, such that the cable 320 coming from the control box 310 also remains vertical and taut and is formed around a small non-rotating hook or pulley 356. The variable festoon is formed by allowing the cable to be suspended between these two points. A second rotatable large diameter pulley 352 is supported at the bottom of the loop, or curve, between the two points, with the cable being partially wrapped about the lower half of the pulley's periphery. Attached to, and located below this second pulley 352, is a weight 360 which pulls the pulley 352 and cable 320 downward to maintain the cable taut between the two points. Therefore, the weighted pulley moves down when the module moves up, and the weighted pulley moves up when the module moves down, as previously stated, to permit the cable 320 to feed in and out during movement of the module. The spacing between the two points of the festoon, their height above the attic floor, the length of the cable, and the mass of the weight, is pre-determined to allow the variable festoon to function properly, i.e., to take up and feed out an exact length of the taut cable that enters and exits the attic when the module moves up or down. As stated above, the large rotatable pulley 358 and second point 356 of the festoon can be attached via "other means." The other means can be a stand supported by the attic floor.

Figure 2:
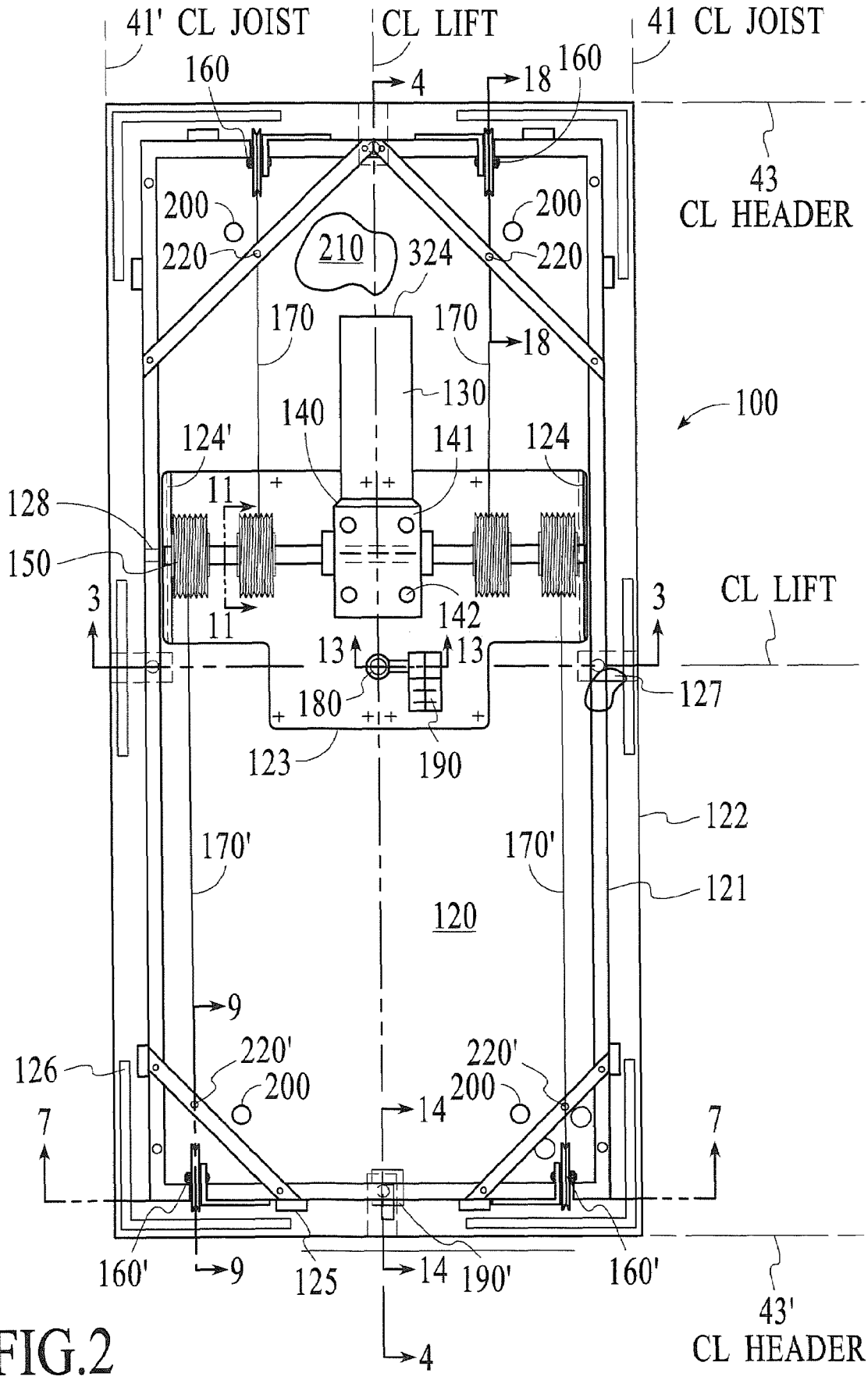
FIG. 2 is a top or plan view of FIG. 1, omitting top, joists, and headers.
Figure 3:
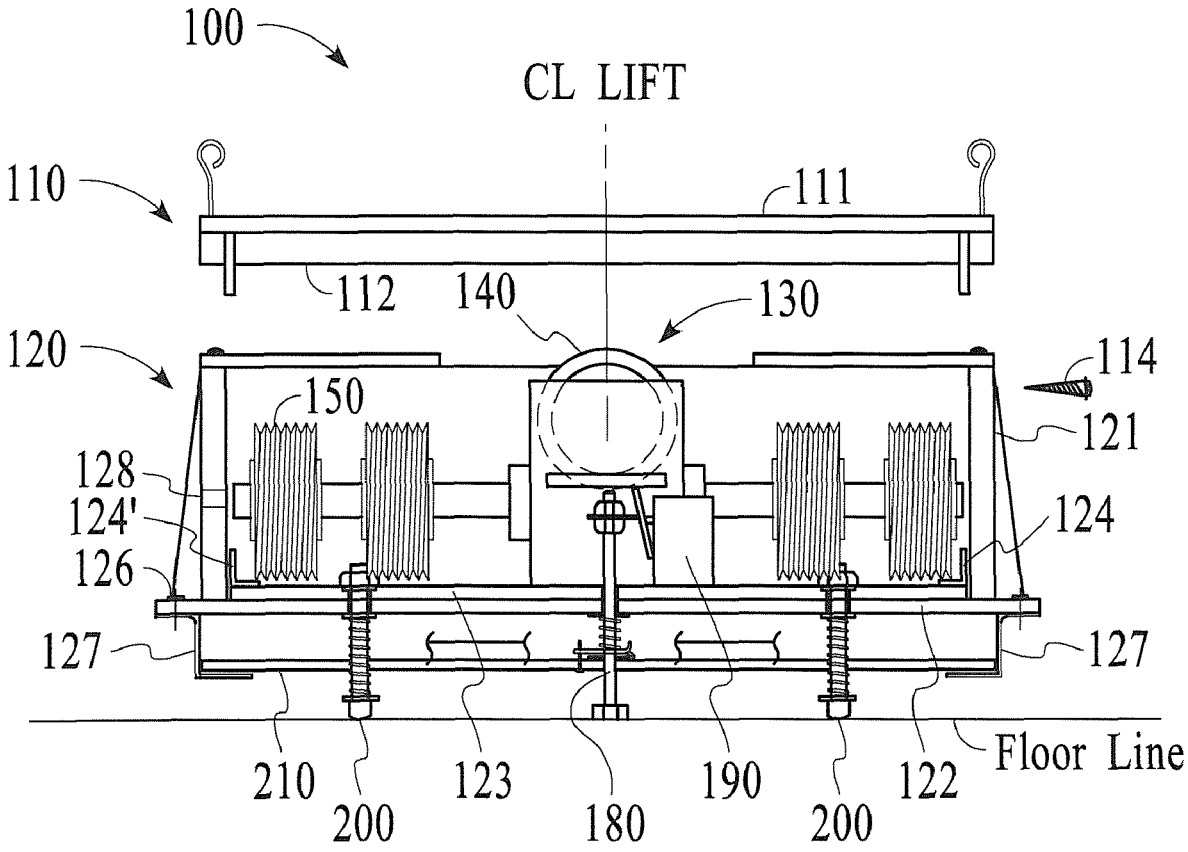
FIG. 3 is a sectional view of FIG. 2 including the top taken along lines 3-3.
Figure 4:
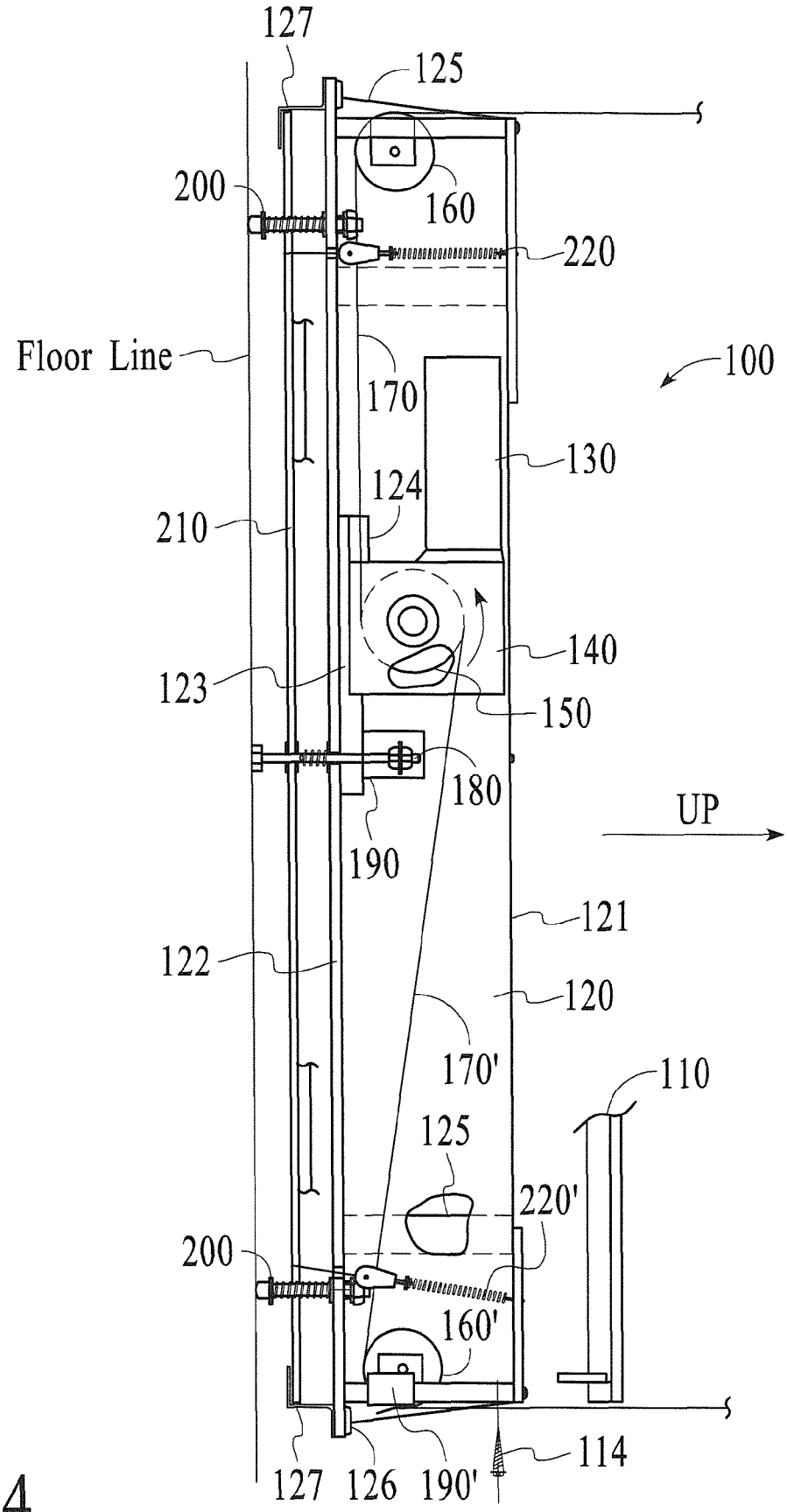
FIG. 4 is a sectional view of FIG. 2 including the top taken along lines 4-4.

FIGS. 2, 3, and 4 show plan and sections of module 100, including platform 110 and enclosure 120 which houses and supports power mechanism 130. The power mechanism 130 includes gear-motor 140, gear reducer 141, and electric motor 324. The gear reducer 141 is attached to enclosure 120 via bolts 142. The module also includes a shaft 151 and sheaves 155 installation 150, a key to installation, two pulley installations 160 and 160', and two wire cable installations 170 and 170'. The module also includes travel limit trigger mechanism installation 180 and limit-switch installation 190 and 190' with upper and lower limit switches 325 and 325' (see FIG. 21).

The enclosure 120 consists principally of enclosure frame 121, enclosure bottom 122 which is attached permanently to frame, gear reducer support 123 attached to bottom and frame, angle attachments 124 and 124' (at ends of support 123) attached to support 123 and enclosure frame 121, eight tapered shims 125 for guiding module 100 into the opening area 50 of frame 40, six cushion tapes 126 and four "z" shaped supports 127 for supporting child safety shield 210. The frame 121 and bottom 122 of enclosure 120 may be constructed from wood, metal, aluminum, etc., molded rubber, and plastic or the like. The structure of enclosure 120 and platform 110 should be as light as possible but still structurally sound. The bottom 122 can, if made stiff enough, support the entire power mechanism 130 without the aid of frame 121. Bottom 122 would be separated from platform 110, as required, but attach either to platform 110 or to six stanchion supports at the four corners and two mid-points of the bottom. Finally, the enclosure 120 provides for four spring-loaded plungers 200 and two each slack cable monitoring devices 220 and 220' for the wire cables 170 and 170'. Detailed description of most of the above-mentioned installations, and parts thereof, are further shown and discussed in the accompanying FIGS. 5 through 18. Electrical drawings, FIGS. 19 and 21, also will be discussed later and described in detail.

Figure 5:
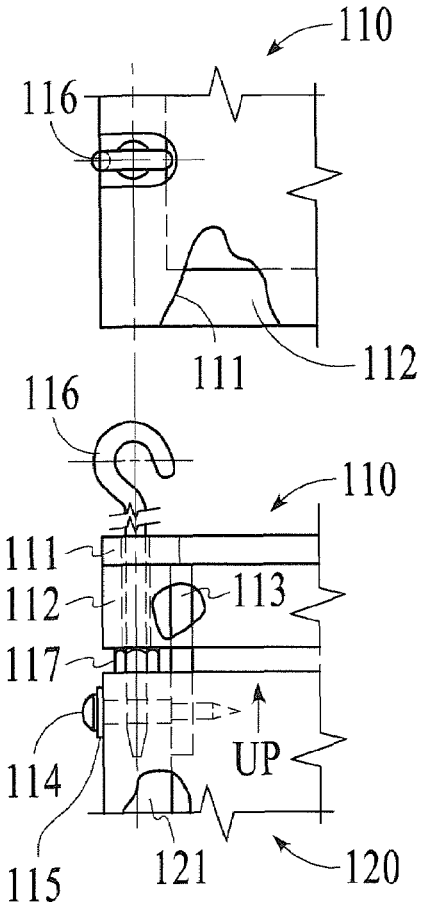
FIG. 5 is a partial view of FIG. 3 showing installation of the platform top and attach points for tie downs for items to be lifted.
Figure 6:
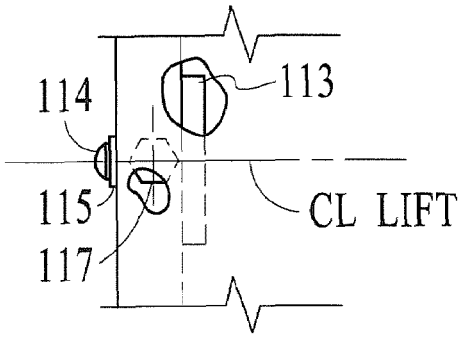
FIG. 6 is a plan view of FIG. 5.

FIGS. 5 and 6 illustrate the attachment of platform 110 to enclosure 120 as well as bungee tie down cords (not shown) to four eye hooks 116 attached to enclosure 120. The bungee cords are for securing items to be supported and lifted by the module's platform 110. Platform 110 is spaced from enclosure 120 by a plurality of eye screws 117 wherein the heads of the screws 116 support the platform 110. The space between platform 110 and enclosure 120 serves as a vent area for air to enter in and circulate through the enclosure 120, providing cooling for the gear-motor 140 if needed. Additional vents could also be provided, if needed, by strategically locating same in the frame 121 or bottom 122 of enclosure 120. The screws 117 also may serve to separate a deeper platform 110 or enclosure 120 than that shown. The deeper platform or deeper enclosure would serve to increase the total height (or depth) of the entire module 100 to more nearly fit the depth of a particular frame 40 between ceiling 20 and floor 30. Platform top 111 is attached to frame 112 to form platform 110 of module 100. Frame 121 of enclosure 120 below platform 110 is separated from and serves to support platform 110. Platform 110 is attached releasably to enclosure 120 using screws 114 for quick and easy access to power mechanism 130, installed within frame 121 and bottom 122 of enclosure 120. Four tabs 113 are attached permanently to frame 112 of platform 110 to enable screws 114 with washers 115 to be threaded into the tabs.

A clearance hole for each screw 114 is formed into frame 121 of enclosure 120. Therefore, when screws 114 are removed, the platform 110 can be lifted easily from enclosure 120. Four eye hooks 116 extend through clearance slots formed into frame 112 of platform 110 and are threaded into frame 121 of enclosure 120. Therefore, the hooks 116 are anchored to enclosure 120 and not to platform 110.

Figure 7:
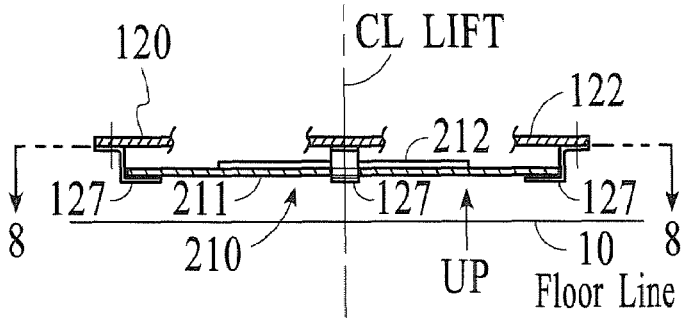
FIG. 7 is a sectional view of FIG. 2 taken along line 7-7 showing the child safety shield beneath the enclosure bottom.
Figure 8:
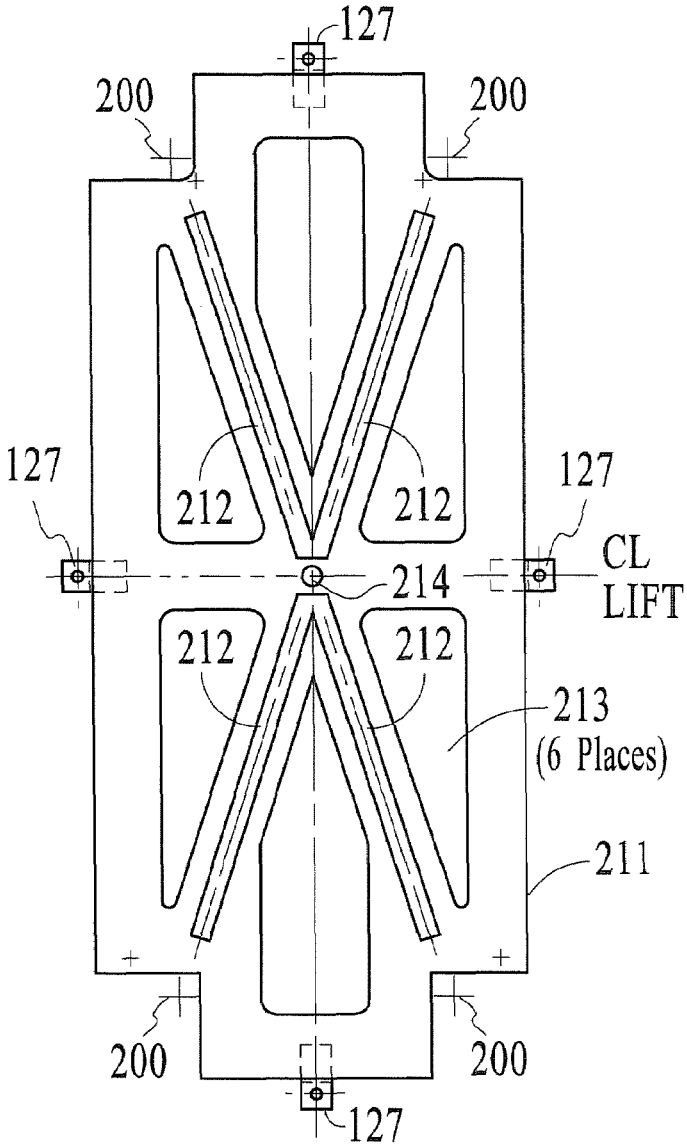
FIG. 8 is a sectional view taken along lines 8-8 of sectional view of FIG. 7, further showing the child safety shield in plan.

FIGS. 7 and 8 further show and describe details of a child safety shield assembly 210 loosely supported beneath enclosure 120 by "z" shaped metal supports 127, attached to bottom 122 of enclosure 120. The shield 211 may be made from light-weight wood, sheet metal, plastic or like materials, which, in turn, are stiffened by stiffeners 212 of like materials and attached permanently to shield 211. Cutouts 213 are provided in shield 211 to further lighten the shield. Cutouts are further made at corners of the shield 211 to clear the four spring-loaded plungers 200. A clearance hole 214 is formed in shield 211 at the intersection of the two lift centerlines. If a child, or any person or thing, comes in contact with the shield assembly 210, as it descends vertically downward, the shield will move up relative to the bottom 122 of enclosure 120. This movement causes actuation of the lower travel limit (spring-return) trigger mechanism 180 to open the normally-closed lower limit switch 325 within enclosure 120, causing module 100 to stop immediately. (Mechanism 180 and lower limit switch 325 are further shown and described in detail in FIG. 13). Thus, injury to a person is prevented.

Figure 9:
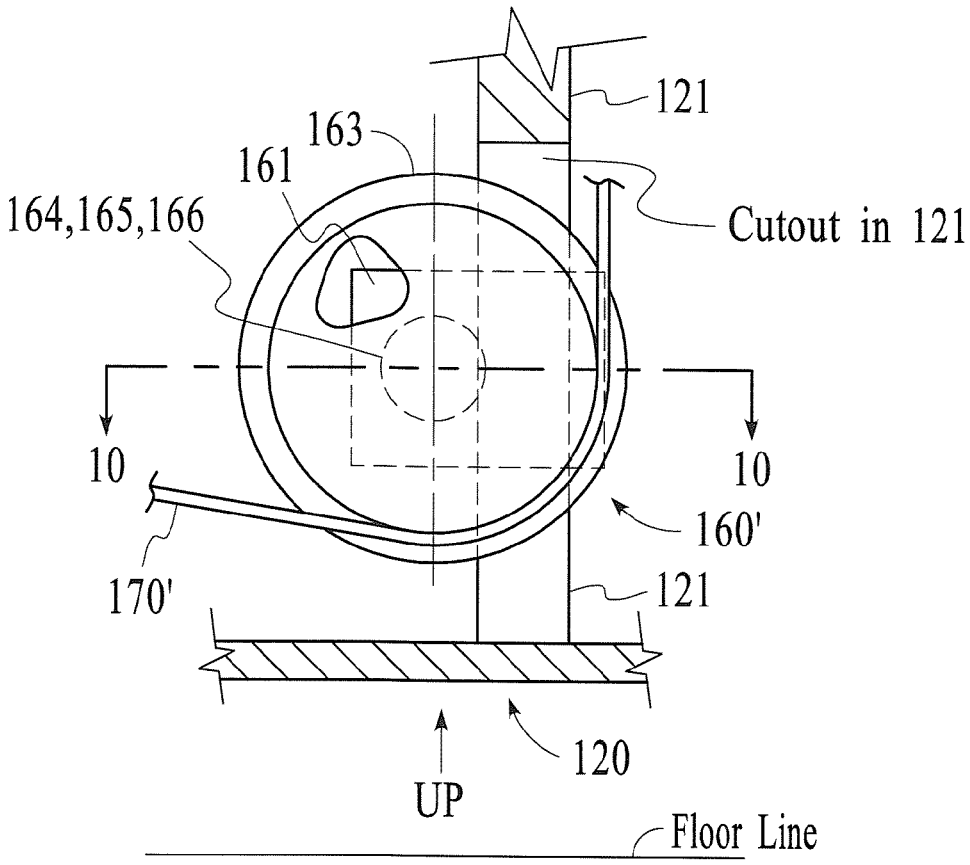
FIG. 9 is a sectional view of FIG. 2 taken along lines 9-9 showing installation of one of four cable pulleys.
Figure 10:
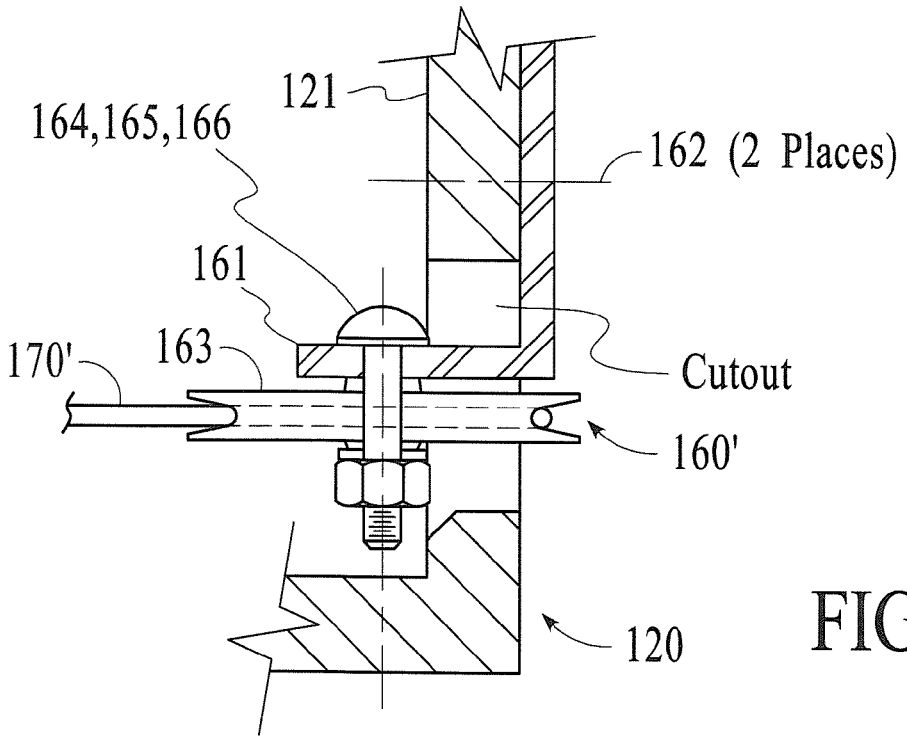
FIG. 10 is a sectional view taken along lines 10-10 of FIG. 9.

FIGS. 9 and 10 show a cutout in frame 121 of enclosure 120, being occupied by pulley installation 160'. Each of the four wire cables 170 and 170' are spaced apart from one another in a horizontal plane to provide stability to the module. The wire cables can be spaced apart in a horizontal plane by the following example. Each of the four pulleys 163 direct wire cables 170 and 170' from a horizontal direction while the cables are in enclosure 120 to a vertical direction while they are out of the enclosure and into the frame opening 50, to be installed at the attic floor 30. Pulleys 163 are rotatably mounted, via mounting screws 164, lock washers 165, and nuts 166, relative to stationary steel support angles 161. Two bolts 162 firmly attach support angles 161 to enclosure frame 121 of enclosure 120. Pulleys 163 rotate on bearings within a hub of the pulley. The hub, therefore, is stationary relative to the rotating pulley and allows nut 166 to be tightened firmly against lock washer 165, both supported on screw 164. Screw 164 is, in turn, supported by angles 161 which are attached permanently to frame 121 of enclosure 120. It should now become obvious that the pulley installation 160 plays a very important part of the power lifting mechanism 130, in that it not only changes the cable direction within and outside the enclosure 120, but also become an integral part of the module's enclosure. Each of the four pulleys 163 shoulder a force equal to the resultant force of the cable tension while being wrapped approximately 90° about the circumference of the pulley. During operation of the module 100, frame 121 of the enclosure 120, particularly the sides running parallel to the cables 170 and 170', also become an important part of the structural integrity of the enclosure 120. This is due to the sides taking on bending and compression, caused by opposing cable tension forces on pulleys 163. If it were not for the sides of frame 121, the bottom 122 of enclosure 120 could buckle.

Figure 11:
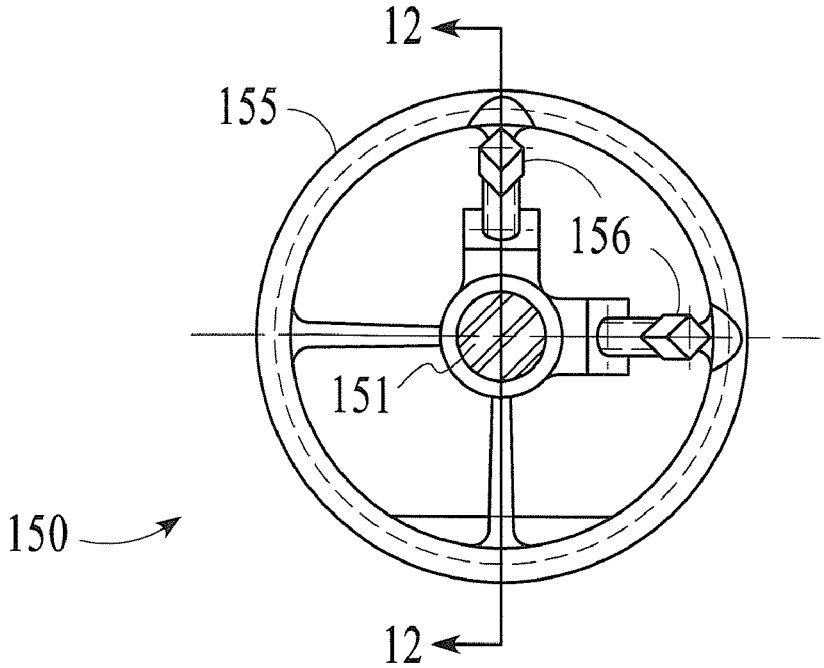
FIG. 11 is a sectional view taken along lines 11-11 of FIG. 2 showing a typical sheave installation on the single continuous drive shaft.
Figure 12:
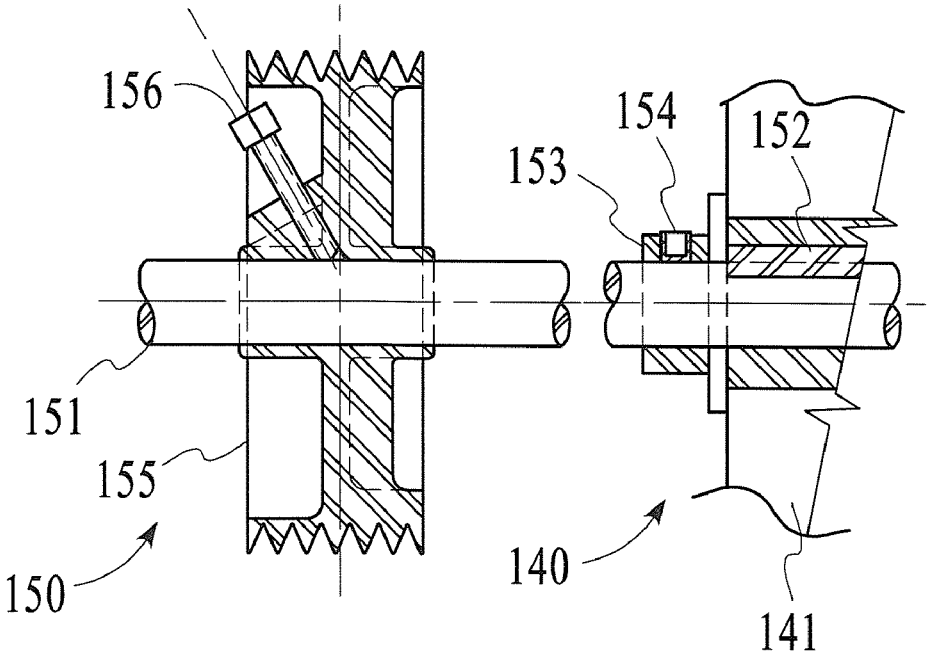
FIG. 12 is a sectional view taken along lines 12-12 of FIG. 11 showing locking screws to lock the sheave to the shaft and keys to lock the shaft to the reducer.

Turning now to FIGS. 11 and 12, the wire cables are connected to a lift line spooling device. The lift line spooling device is capable of guiding the wire cables to spool or unspool on the shaft. One example of a lift line spooling device is cable sheaves 155. The installation 150 of cable sheaves 155 to a single continuous shaft 151 and the installation of the shaft 151 within the gear reducer 141 of gear-motor 140 is shown. Note that shaft 151 is first directed into and through an opening hole, in the gear reducer's worm gear or worm gear output adaptor. The shaft 151 has a close slip fit to the internal hole in the gear or gear adaptor and is secured within the reducer 141 by the use of keys 152 and collars 153 which are tightened with set screws 154 to shaft 151 at each side of reducer 141. Keys 152 are standard but are fitted to fit accurately into an elongated slot machined into the shaft 151 and that of the gear or gear adaptor of reducer 141. Rotation of the gear or gear adaptor by gear-motor 140 imparts rotation to the shaft 151 and to shaft mounted sheaves 155. The shaft is preferably made of steel. The steel shaft would preferably be a hollow, heavy wall, pipe or tube to reduce weight. Cables 170 and 170' extend therefrom, as shown in FIGS. 1 and 4, to pulleys 163 of pulley installations 160 and 160'. Sheaves 155 should be centered on shaft 150, as shown in FIG. 2, to align with installed pulleys 163 at opposite ends of enclosure 120. A clearance hole 128 can be formed in frame 121 of enclosure 120, as shown in FIGS. 2 and 3, to provide access to set screws 156 in sheave 155. Set screws 156 in sheaves 155 are tightened firmly after sheaves 155 are rotated and synchronized with each other at final assembly. Minor synchronization adjustments can be made easily by loosening screws 156, rotating the sheave or sheaves 155, and then firmly tightening the screws 156. However, some sheaves not only have the set screws, but also a keyway opening in the opening for the shaft. Therefore, the shaft can have a keyway (slot) machined into the shaft, and a key can be fitted to the sheave and the shaft to prevent any rotational movement of the sheave and the shaft. The set screws are then used only to prevent movement of the sheave relative to the shaft in an axial direction only. Therefore, in order to use a minimum number of parts as shown, one should select a gear-reducer that has a through shaft internal opening as its output. A single continuous shaft, with two sheaves mounted at opposite ends thereof, provide the ultimate in precision, strength, and simplicity at minimum costs. In another embodiment, a single continuous drive shaft could be used with a reducer which has the shaft to extend outward from one or both sides of the reducer, wherein the shaft could be a part of, or attached to, the gear or gear adaptor. Due to the length, this longer shaft can be supported somewhere along its length. For example, the continuous shaft can be supported and coupled to a short external output shaft of a reducer or the shaft might be supported and driven by and away from the reducer wherein the drive to the continuous shaft would be a chain or gearing. In yet another embodiment, a non-continuous shaft could be two shafts mounted in-line, and rotated from and coupled to a reducer, having a short output shaft on each side of the reducer. This, too, might require a support at the end of each shaft. Each of the above options as well as similar designs would fall under the scope and intention of this invention.

Figure 13:
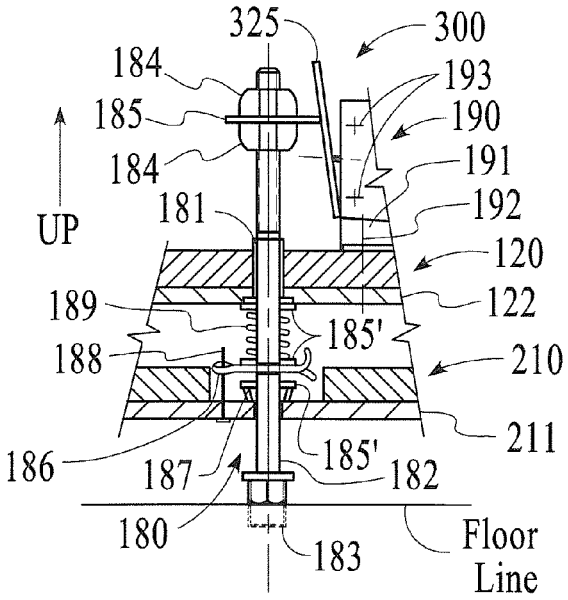
FIGS. 13 and 14 are sectional views taken along line 13-13 and 14-14, respectively, of FIG. 2 showing lower and upper limit switch installations.
Figure 14:
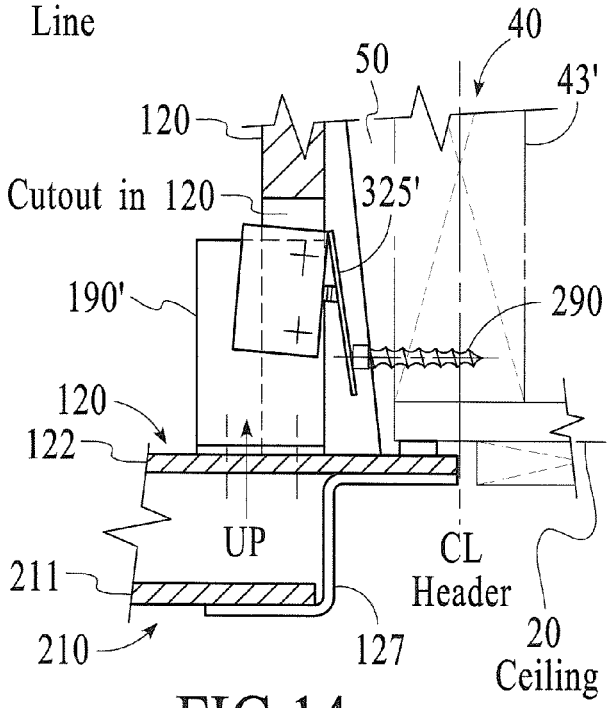

FIGS. 13 and 14 show and define the lower and upper limit switch trigger installations. FIG. 13 shows washer 185 of installation 180 striking lower limit switch 325. FIG. 14 shows upper limit switch 325' striking the trigger 290. The entire electrical system installation schematic 300 is shown and described in further detail in FIG. 21 wherein the limit switches 325 and 325' are identified. Numerals 190 and 190' show detail parts which support the two switches. Washer 185 (or cam) of FIG. 13 and lag screw 290 of FIG. 14 are adjustable such that minor adjustments can be made toward and away from the switches. This changes the point at which the switches trip (opens the circuit of the normally-closed switches) to stop module 100, thus limiting its maximum travel up and down. FIG. 13 shows a shoulder bushing 181 pressed into a hole formed in enclosure 120 at the center of the lift module, as shown in FIG. 2. An elongated bolt 182 is slidably guided through the hole (guide) of bushing 181. The hole in bushing 181 closely fits the outside diameter of the bolt. Bolt 182 further occupies a clearance hole formed in the shield 211 of child safety shield assembly 210 as shown. Two jam nuts 184 are shown to firmly clamp washer 185, for adjusting. Once set, the adjustment will not change. The lower limit switch 325 is shown such that the position of the bolt 182 has actuated the normally-closed switch 325 to stop the downward travel of the lift module. Cotter pin 186 resting on finishing washer 187 is caused to move upward relative to a downward movement of the module and shield to cause actuation of the switch 325. Compression spring 189 is sandwiched between two washers 185' to cause the cotter pin 186 to push against washers 185' and finishing washer 187, thus limiting the downward position of bolt 182 in enclosure 120. Pin 188 protrudes through safety shield 211 and eye of cotter pin 186 and is positioned radially about bolt 182, after rotational adjustment of bolt 182 has been made to trip lower limit switch 325, at the desired point of travel. Once pin 188 has been positioned through cotter pin 186, any additional minor readjustment to the switch 325 must be made using jam nuts 184 to rotationally reposition washer cam 185. Screw cover 183 needs to be installed on bolt 182 before any adjustments are made. As will be more completely discussed later, there is a slack cable monitoring system 220 and 220', which, when energized, also causes relative movement of the child safety shield assembly 210 to enclosure 120. This movement, in turn, stops the downward travel of the entire lift module. It should be noted that energizing the lower limit switch via movement of bolt 182 when contacting floor 10, that this movement is independent of any movement or position of the child safety shield assembly 210. FIG. 14 shows the simplicity of the upper limit trigger 290, which can be adjusted easily to change the position of lift module 100, when raising enclosure 120 of module 100 into opening 50, to contact ceiling 20.

Figure 15:
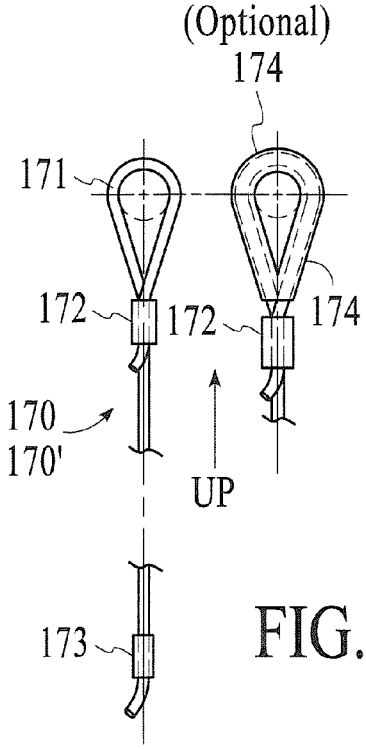
FIG. 15 shows opposite ends of a typical cable using standard methods to secure same to cable sheaves and to supports on the attic floor.
Figure 16:
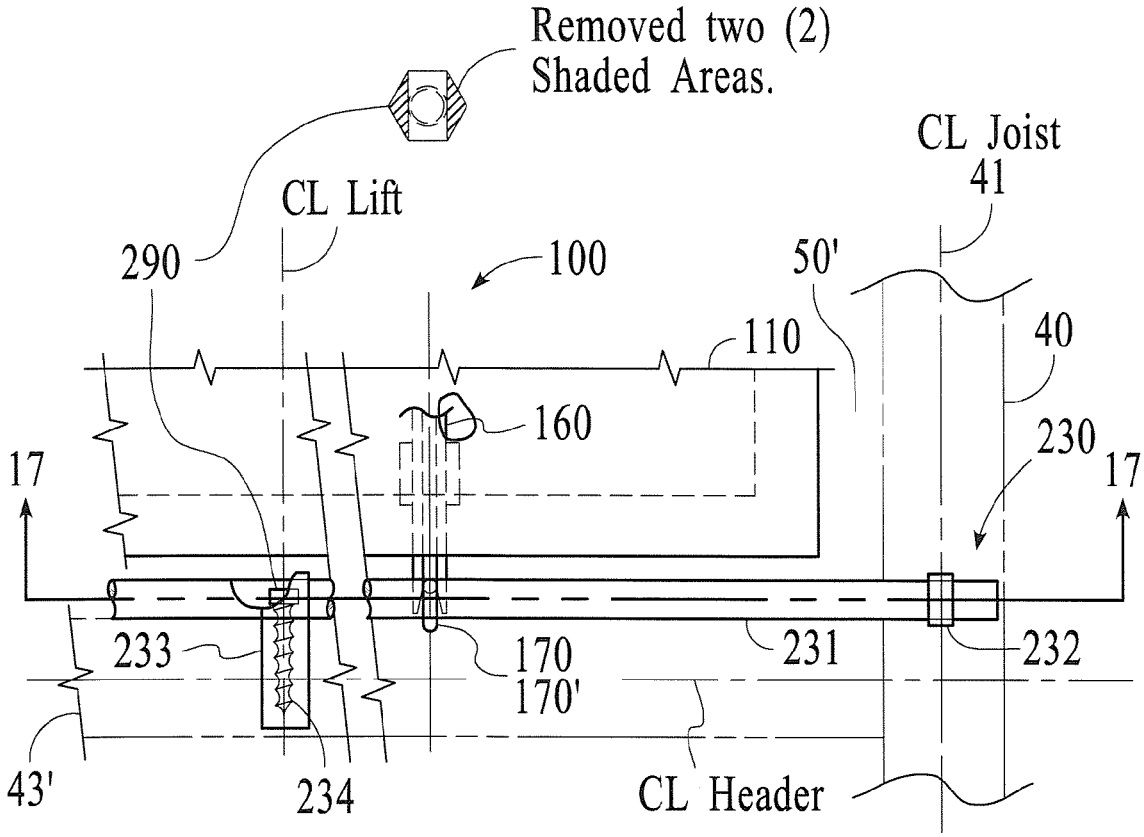
FIG. 16 shows a partial plan view of an embodiment for installing the eye ends of two pairs of cables in the attic opening using an elongated rod through cable eyes, supported by the attic floor and joists.
Figure 17:
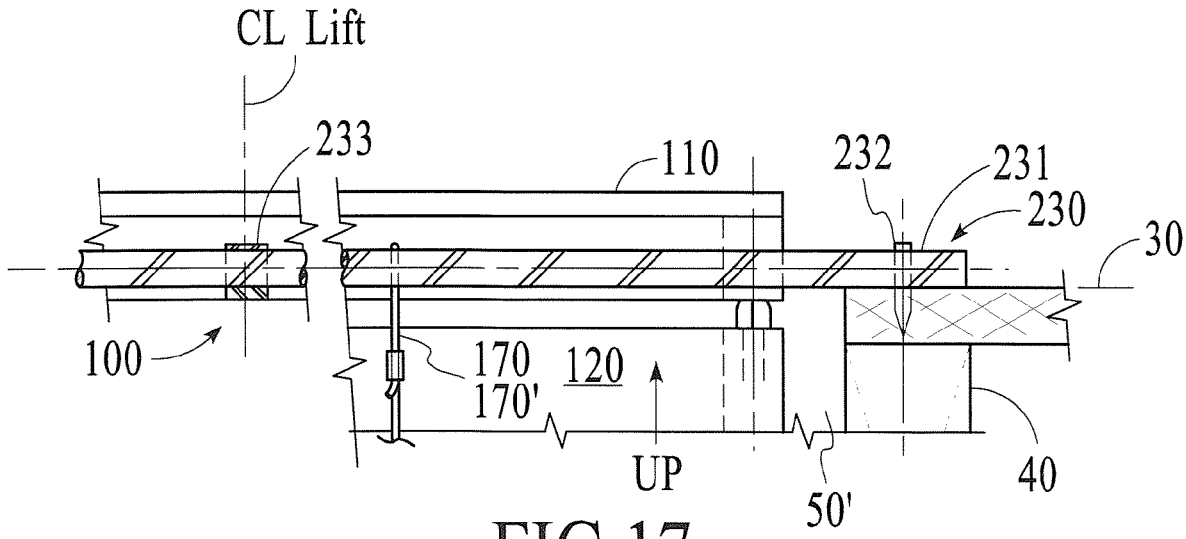
FIG. 17 is a sectional view taken along lines 17-17 of FIG. 16.

FIG. 15 shows a typical and standard way to form attachment ends of the cables used in this invention. Each pair of assembly 170 and 170' is shown having at one end of cable 171 an eye or loop formed, with the end of the cable being mechanically swaged back to the cable body, using a standard thimble 174. The opposite end of cable 171 has a stop 173 swaged thereto. The loop end of cable assembly 170 and 170' is installed as shown in FIGS. 16 and 17 to the attic floor 30, while the opposite end is attached to the grooved cable sheaves 155 as shown in FIGS. 11 and 12. Also shown in FIG. 15 is an optional configuration of the loop end of cable 171, wherein a cable ferrule 174 is used. The loop of the cable 171 is formed around the ferrule 172 prior to being swaged, as shown, using thimble 174.

FIGS. 16 and 17 are presented to show and describe the simple installation of cables 170 and 170' to the attic floor 30, above joists 41 and 41' of frame 40. Cable support rods 231 are fed through the two pairs of cables 170 and 170' located at opposite ends of the attic opening 50, and to and through the opening with the rods supported as shown. An additional center support, a hole strap 233, is secured to header 43 and 43' with a round head wood screw 234. Each end of the support rod 231 is further clamped onto floor 30 by strap 232, as shown, to prevent movement of any kind. The module 100 is shown positioned relative to the frame 40 cutout defining the equal space 50' around the module, when the module is lifted to its uppermost position into the opening 50. Upper limit switch adjusting lag screw 290 is also shown here in FIG. 16 and in FIG. 1, as being screwed into header 43' of frame 40. Screw 290 is made from a standard hex head lag screw with opposite sides of the screw head being removed, to form a rectangular shape as viewed from the end of the screw's head. By rotating the screw in and out, module 100 can be caused to stop at the desired height as shown in FIG. 14, with contact to the cushion 126 of the enclosure 120 at ceiling line 20.

Figure 20:
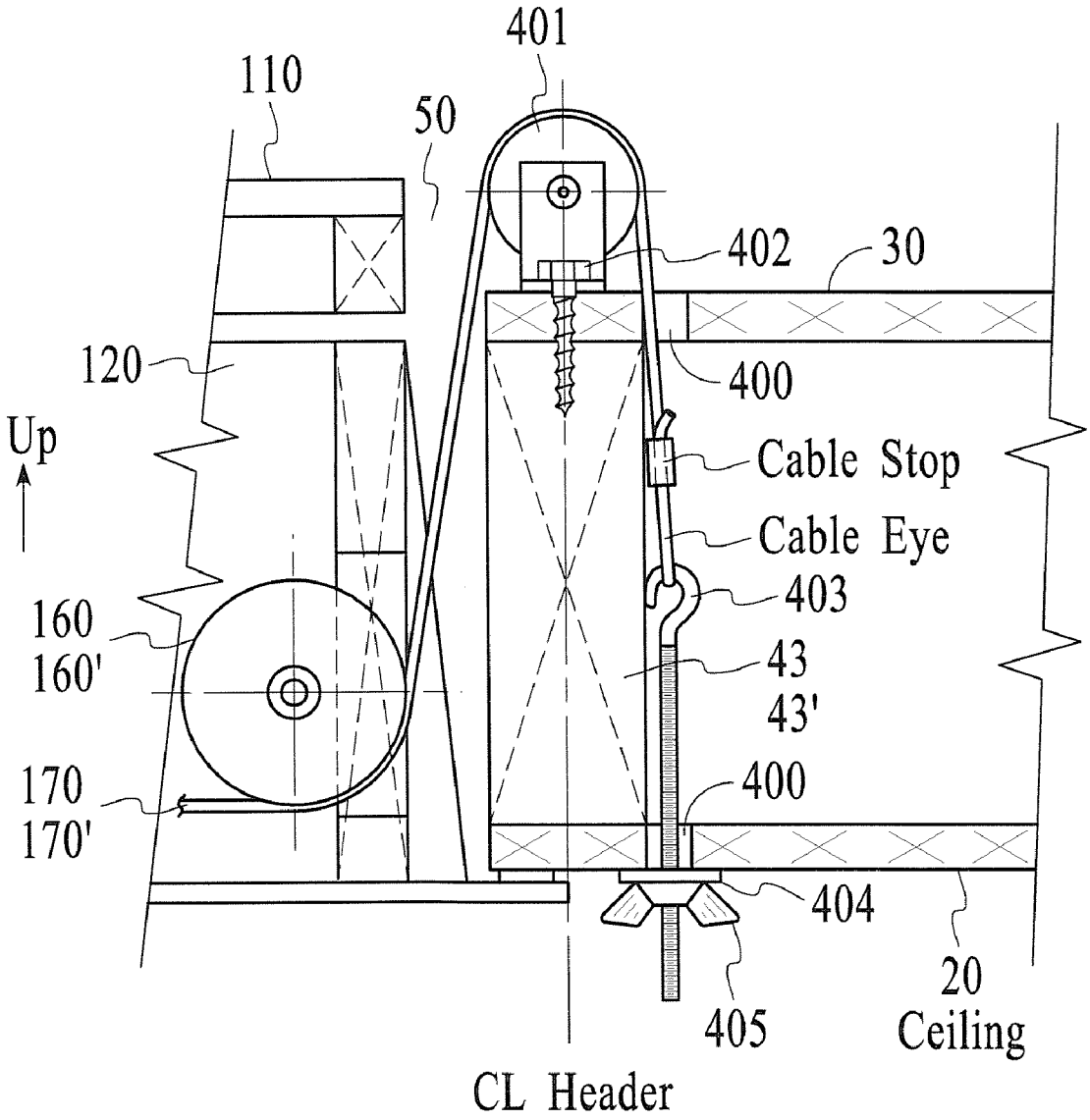
FIG. 20 shows a schematic of another embodiment of installation of the cable ends into the opening of the attic.

FIG. 20 shows an alternative embodiment for installation of the cables 170 and 170' in order to ensure proper closure of the module into the opening 50 of the attic. As shown in FIG. 20, a pulley 401 is secured to the attic floor 30 using two lag screws 402 at each cable. Two holes 400 are drilled into the support structure to provide clearance for the end of each cable. The end of each cable is hooked onto threaded eye hook 403. Located on the outside of each cable and directly below the ceiling 20 are washer 404 and wing nut 405. The wing nut 405 can be adjusted as necessary to provide proper closure of the module to the ceiling 20.

Figure 18:
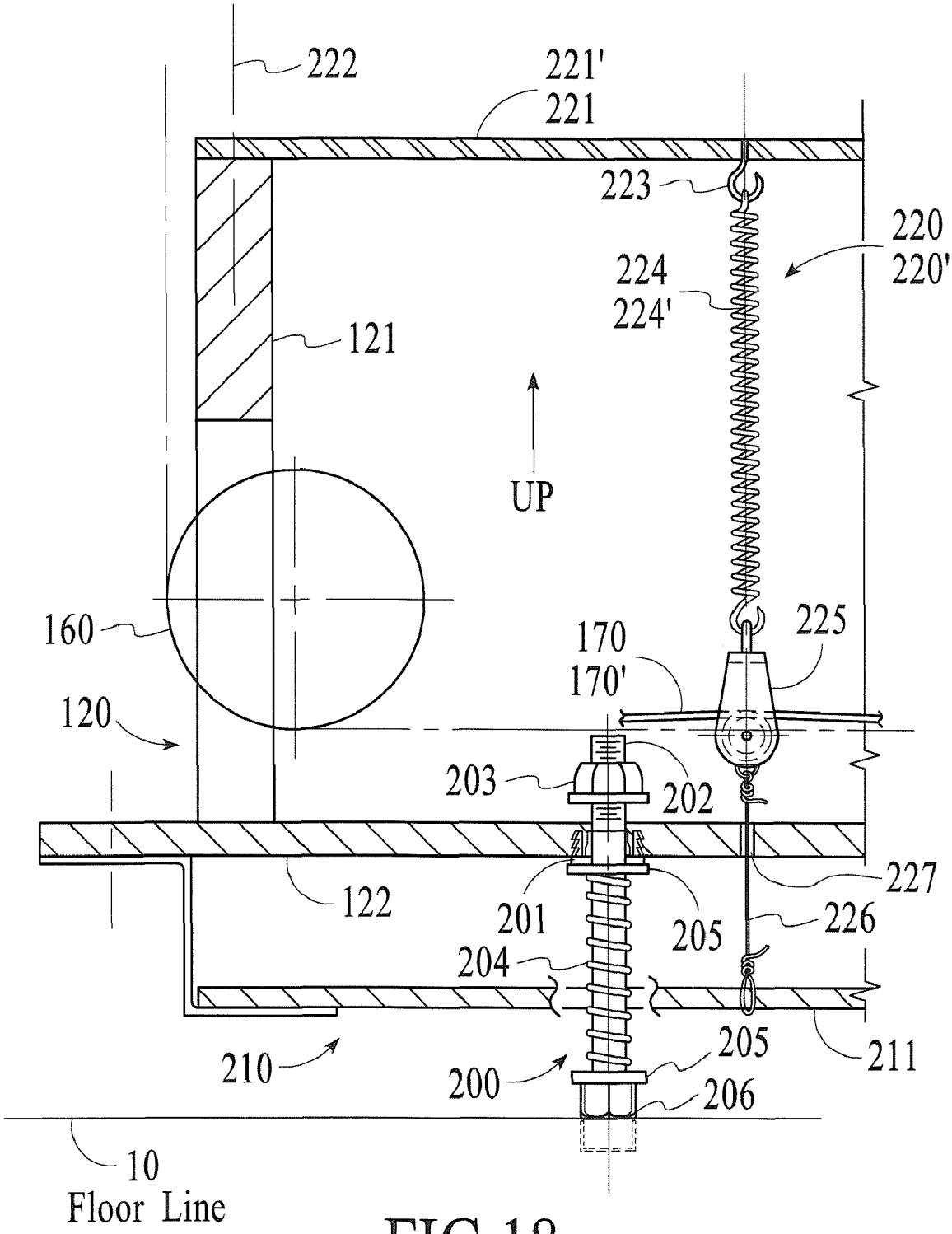
FIG. 18 is a sectional view taken along lines 18-18 of FIG. 2, showing installation of one of the four spring-loaded plungers contacting the garage floor and showing installation of one of four cable monitoring devices to detect and take-up slack cables while simultaneously triggering the down limit switch, by moving the child safety shield, to stop movement of the lift.

FIG. 18 shows two different mechanical installations in enclosure 120 of module 100. One of four spring-loaded plungers 200 is shown contacting floor 10. The plungers contact the floor just after the down limit switch has been actuated to stop the downward movement of module 100. The plungers are installed at the corners of bottom 122 of enclosure 120, as shown in FIGS. 1 through 4. Each plunger 200 consists of parts numbered 201 through 206. A long hex head bolt 202 slides freely up and down through tee nut fastener 201, pressed into bottom 122. Compression spring 204 is compressed against washers 205 which, in turn, contact nut fastener 201 and the underside of hex head bolt 202, forcing cap 206, mounted on the head of bolt 202, to make contact with floor 10. Self-locking nut 203 is threaded onto the end of bolt 202, both protruding into the inside of enclosure 120. The position of nut 203 on bolt 202 determines how much bolt 202 with end cap 206 extends out of bottom 122 of enclosure 120 when the module 100 is lifted from floor 10. The physical characteristics of compression spring 204 are preselected to provide the desired initial and final load within the installed assembly. Compression of spring 204, upon contact of end cap 206 with floor 10, softens the landing and prevents lateral movement of module 100, while loading and unloading items being transported.

FIG. 18 also shows one of four slack cable monitoring systems, two each 220 and 220'. The centerline of each extension spring 224 and 224' is installed perpendicular to cables 170 and 170', directed from sheaves 155 and their corresponding pulleys 163 within enclosure 120, as shown in FIG. 4. Extension spring 224 and 224' is hooked to and stretched between eye hook 223, secured to support 221 and 221' which, in turn, is secured to enclosure frame 121 of enclosure 120 by screws 222, and between the eye of pulley 225. Pulley 225 is shown to pull on cable 170 and 170'. The spring rate of springs 224 and 224' are predetermined, and springs are selected to pull up on cable 170 and 170' a certain amount such that, when a slack cable is detected, for any reason, the pulley will tend to not only take up some of the slack, but also to pull child safety shield assembly 210 up, relative to enclosure 120 in order to move shield 211 a sufficient amount to trigger the lower limit switch 325, thus stopping the downward motion of module 100. Flexible wire 226 is shown to connect pulley 225 to child safety shield assembly 210. Wire 226 is threaded through clearance hole 227 in bottom 122 of enclosure 120. Wire 226 is installed after the cable is pulled upward as shown, thus applying tension to the pulley even when module 100 rests on the floor. Wire 226 should only move shield 211 when a cable becomes slack. Therefore, movement of shield 211 serves not only to stop downward movement of module 100 when acting as a safety shield, (discussed previously using FIG. 7), but also when a slack cable is detected. As designed, a single trigger (bolt 182 with washer 185 (cam) and single switch 325 stops the downward movement of module 100 for three events: when module 100 reaches its lowest position to floor 10; when the child safety shield is struck; and when a slack cable is detected.

Figure 19:
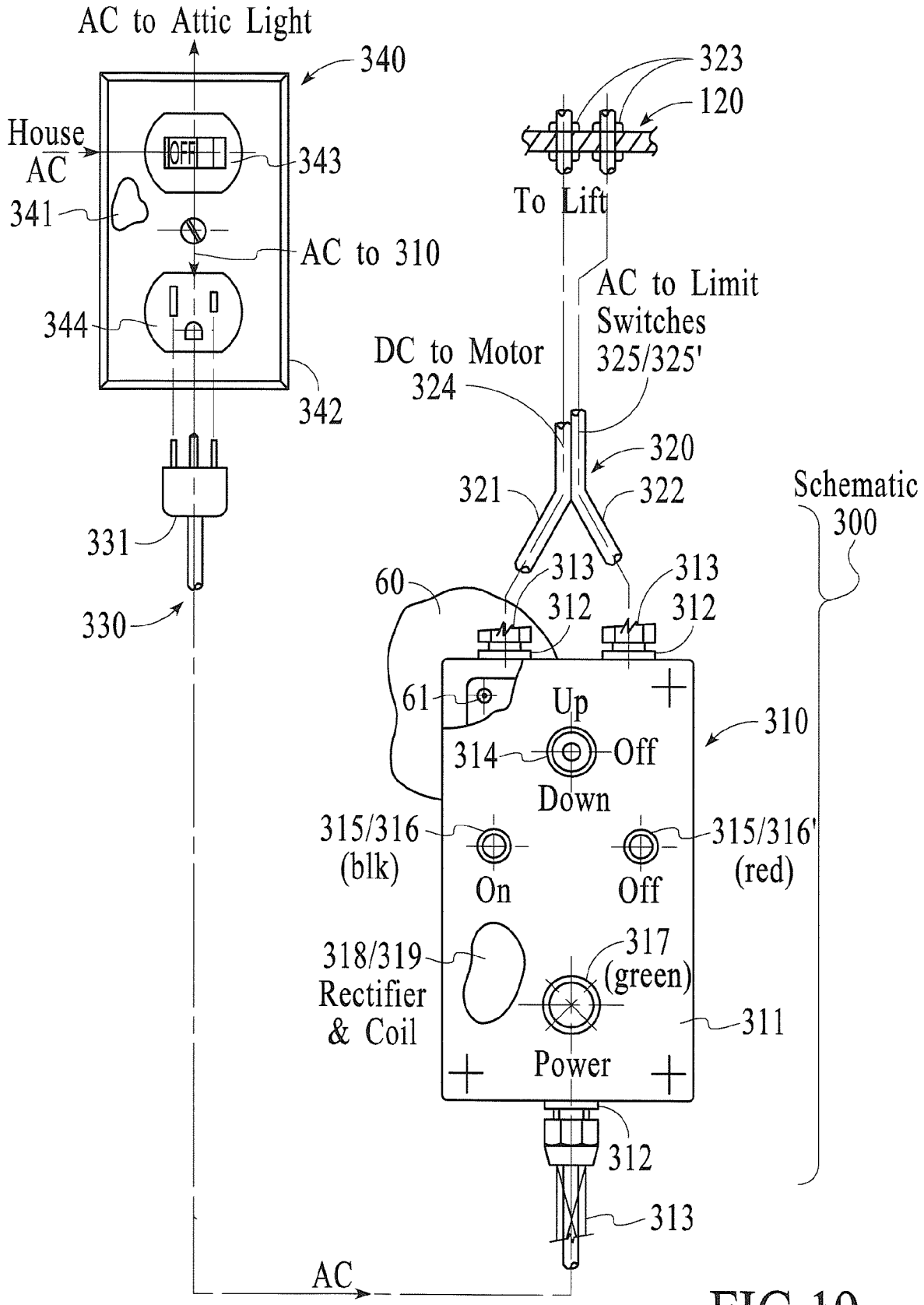
FIG. 19 shows a combination switch controlling AC power to an attic light and to a control box providing AC and DC power for lift operations of the module.

FIG. 19 shows an electrical system 300 designed to lift module 100 up and down as is required to meet or exceed the design specifications for the system. A combination switch 340 provides AC power to wiring control cables 330 which, in turn, supplies the power to control box 310. When the motor is a DC motor, then rectifier 318 in control box 310 converts AC to DC for the module's motor, through wiring cable 321. Control box 310 also provides AC to limit switches 325/325' in module 100 through cable 322. These cables 321 and 322 are first fed to a quick disconnect 326 (not shown) and then through enclosure 120 of module 100 using grommets 323. The combination switch 340 replaces a standard attic light switch located in close proximity to control box installation 310. Box 311 of control box 310 is mounted to the outside of wall 60 through the use of appropriate wallboard screws 61. Combination switch body 341 installed within wall 60 is enclosed and covered by switch nameplate 342. Switch 343 and plug receptacle 344 are part of switch body 341. Plug 331 of cable 330 plugs into receptacle 344. When switch 343 is switched to the ON position, AC power is supplied to light 317 of box 311, to toggle switch 314, two pushbuttons 315 with Black and Red caps 316 and 316', and to rectifier 318 and coil 319, all mounted within box 311. Nut 312 is screwed into box 311 to allow attachment of three strain reliefs 313 for cables, as shown. If practical, box 311 of control box 310 should be installed in close proximity to, but not too close for safety reasons, to attic opening 50 formed by the cutout of frame 40. Also for safety, the child safety shield assembly 210 and four corners on bottom 122 of enclosure 120 can be painted yellow. In addition, a two-inch wide yellow stripe can outline the periphery of enclosure bottom 122 of enclosure 120, painted as 11, on floor 10 in FIG. 1. A similar stripe can outline the periphery of cutout opening 50 on the attic floor 30. And last, a decal should be added to platform top 111 of platform 110, reading as follows: NOT FOR LIFTING PERSONNEL. Operation is simple and straight forward in that plug 331 is plugged into receptacle 344, and should remain in receptacle 344 except when working on electrical system 300 for troubleshooting, etc. Switch 343 now can be turned to the ON position to supply power to the controls. After seeing an indication of readiness by viewing that the Green light 317 is ON, the operator: 1) selects what direction of travel he (or she) wants, UP or DOWN, by use of the toggle switch 314; and 2) pushes the ON (Black) pushbutton to start movement of the module 100 in the direction selected above. The operator may wish to stop before the module reaches its extreme position, UP or DOWN, by pushing the OFF (Red) pushbutton, or flipping the toggle switch to the center OFF position. To restart movement of module 100, the Black ON pushbutton must be pushed again. Otherwise, if nothing causes the module to stop before it reaches the intended limit of travel, UP or DOWN, the module will stop automatically when the UP or DOWN limit switch 325 or 325' have been tripped. To secure module 100 for later use, module 100 should first be raised to its uppermost position in the cutout opening 50, formed between ceiling 20 and floor 30 as shown in FIG. 14. And last, toggle-switch 314 should be moved to OFF (the neutral position), and switch 343 of body 341 should be moved to the OFF position. The lights in the attic and in box 311 will now be OFF and power to control box 310, for operating module 100, will be discontinued.

FIG. 21 shows a schematic of the complete electrical system 300, along with a complete purchased parts list of each electrical part therein, used to operate self-contained self-elevated module 100, carrying its cargo up and down into and out of attic opening 50 from garage floor 10. An operational description of the simple schematic is provided below:

1) Select UP or DOWN on toggle switch 314. (Toggle UP selects module 100 UP direction, and toggle DOWN selects module 100 DOWN direction).

2) Push ON (Black) pushbutton 315/316 to apply power to limit switch 325 or 325' and then to coil of relay 319. Relay 319 contacts close to supply power to bridge (rectifier) 318 and to lock-up ON circuit.

3) Motor 324 will stop if limit switch 325 or 325' is reached or if (Red) pushbutton 315/316' is pushed.

4) If limit switch 325 or 325' has not been reached, power can be reapplied by pushing the ON (Black) pushbutton 315/316.

5) If limit switch 325 or 325' has been reached, toggle switch 314 must be changed to the other direction and then push the ON (Black) pushbutton 315/316.

6) If the toggle switch 314 is in the center (OFF) position, no power can be applied.

In another embodiment, the module can include an alternative power source, other than the electrical system 300. The enclosure 120 can include at least one battery for supplying power to the motor 324. The upper and lower limit switches 325 and 325' would operably be connected to the battery to prevent the battery from supplying power to the motor 324 when activated. Preferably, the battery is at least a 12 volt (V) DC or 24V battery. Preferably, the 12V battery provides at least 35 amperes (A) of power. Preferably, the 24V battery provides at least 16 amperes (A) of power. The battery can be any battery that supplies sufficient power to the motor, such as a gel-cell battery or a cold-crank battery. The battery can be a replaceable battery, such that, when the battery is no longer supplying power to the motor, the battery can be replaced. By way of another example, the battery can be a rechargeable battery. The rechargeable battery can be recharged via solar power. The rechargeable battery also can be removed from the enclosure 120 and placed into a recharging system which is plugged into a plug receptacle 344 to recharge the battery. The recharging system also can be located in the attic and plugged into a plug receptacle 344 located in the attic. In this manner, when the module is positioned in an upper-most position in the opening 50, then the battery contacts the recharging system, and the battery can be recharged. If the power source is a battery, then the battery can be activated to supply power to the motor via a remote control. By pressing a button located on the remote control, the module will move downwards. By pressing the button again, the module will move upwards. If the battery is activated via a remote control, then the battery can include a receiver for receiving a transmission from the remote control to activate the battery. Alternatively, the battery can be activated via a control wire connected to the battery and coming down from the attic to a location along a wall in the garage. The control wire can be installed with a festoon arrangement in the attic.

It should be obvious that applications of the invention can also be applied with equal success to areas other than to attics, such as, to a second floor of a residence, lofts, elevated beach houses, lookout/observation towers, deer blinds, or for storage beneath attic ceilings, etc.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods can also "consist essentially of" or "consist of" the various components and steps. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A lift installation for moving objects between the floors of a first level and a vertically-elevated second level, and wherein the second level has a floor and an opening in the floor, the lift comprising:

(A) a platform for supporting the objects of the size and shape to receive the platform in the opening;

(B) a plurality of lift lines fixed at one end to extend downward from the second level for use in moving the platform; the lift lines being of sufficient length to use in moving the platform between a position resting on the first-level floor and a position exiting into the opening in the second-level floor; and (C) a motor connected to move with the platform and wherein the motor operably is connected to the lift lines for moving the platform between the first and second levels while being supported by the lift lines.

2. The platform lift according to claim 1, further comprising an enclosure attached to the platform.

3. The platform lift according to claim 2, further comprising plungers attached to the enclosure.

4. The platform lift according to claim 1, wherein the lift lines comprise elongated flexible tensioners.

5. The platform lift according to claim 4, wherein the lift lines are selected from the group consisting of chains, straps, ropes, and cables.

6. The platform lift according to claim 1, further comprising a lift line spooling device on the platform connected to the lift lines.

7. The platform lift according to claim 6, wherein the motor provides reversible rotational movement to lift line spooling device.

8. The platform lift according to claim 6, further comprising a gear reducer operably connected between the motor and the lift line spooling device.

9. The platform lift according to claim 8, wherein the gear reducer is self-locking.

10. The platform lift according to claim 8, further comprising a rotatably mounted shaft and four sheaves mounted on the shaft to rotate with the shaft.

11. The platform lift according to claim 10, wherein the plurality of lift lines comprises at least four lift lines.

12. The platform lift according to claim 11, wherein one end of each of the at least four lift lines operably is connected to one of the four sheaves.

13. The platform lift according to claim 11, wherein each of the at least four lift lines are spaced apart from one another in a horizontal plane to provide stability to the platform.

14. The platform lift according to claim 1, further comprising an upper limit switch for limiting upward travel of the platform by interrupting power to the motor when the switch is actuated.

15. The platform lift according to claim 1, further comprising a lower limit switch for limiting downward travel of the platform by interrupting power to the motor when the switch is actuated.

16. The platform lift according to claim 15, wherein the lower limit switch is actuated by a detection of slack in the lift lines.

17. The platform lift according to claim 15, further comprising a safety shield.

18. The platform lift according to claim 17, wherein the lower limit switch is actuated by pressure being exerted on the safety shield.

19. The platform lift according to claim 1, further comprising a power source for the motor.

20. The platform lift according to claim 19, wherein the power source comprises a battery.

21. The platform lift according to claim 20, wherein the battery is rechargeable.

22. The platform lift according to claim 1, wherein the motor is a direct current motor.

23. The lift installation according to claim 1, wherein the lift lines are connected to the floor of the second level.

24. The lift installation according to claim 23, further comprises at least one support rod and wherein the lift lines are connected to the floor of the second level via the at least one support rod.

25. The lift installation according to claim 24, further comprising more than one joist located in the floor of the second level and wherein the opening in the floor is positioned in between the joists.

26. The lift installation according to claim 25, wherein the support rod is connected to and spans at least one of the joists.

27. The lift installation according to claim 1, further comprising a means for adjusting the length of the lift lines.

28. A self-contained, self-elevating platform lift for moving objects between a first level and a vertically-elevated second level, comprising:

(A) a platform for supporting the objects and having a platform top and bottom;

(B) said platform further having an intermediate support between the platform top and bottom for separating the platform top from the bottom and for connecting the platform top to and apart from the bottom to form an interior space area;

(C) a plurality of lift lines for connection at the second level and for moving the platform;

(D) an electro-mechanical power lifting mechanism comprising a motor, gear reducer and a lift line spooling device, wherein each is connected and supported within the interior space area between the platform top and bottom; and (E) such that the motor, gear reducer and lift line spooling device components of the power lifting mechanism within the interior space area between the platform top and bottom are operably connected to the lift lines for moving the platform between the first and second levels while being supported by the lift lines.

29. The platform lift according to claim 28, further comprising an enclosure attached to the platform.

30. The platform lift according to claim 29, further comprising plungers attached to the enclosure.

31. The platform lift according to claim 28, wherein the lift lines comprise elongated flexible tensioners.

32. The platform lift according to claim 28, wherein the lift lines are selected from the group consisting of chains, straps, ropes, and cables.

33. The platform lift according to claim 28, wherein the lift line spooling device is caused to rotate in one direction upon energizing the motor.

34. The platform lift according to claim 33, wherein the motor provides reversible rotational movement to lift line spooling device.

35. The platform lift according to claim 28, wherein the gear reducer is self-locking.

36. The platform lift according to claim 28, further comprising a rotatably mounted shaft and four sheaves mounted on the shaft to rotate with the shaft.

37. The platform lift according to claim 36, wherein one end of each of the at least four lift lines operably is connected to one of the four sheaves.

38. The platform lift according to claim 28, wherein the plurality of lift lines comprises at least four lift lines.

39. The platform lift according to claim 38, wherein each of the at least four lift lines are spaced apart from one another in a horizontal plane to provide stability to the platform.

40. The platform lift according to claim 28, further comprising an upper limit switch for limiting upward travel of the platform by interrupting power to the motor when the switch is actuated.

41. The platform lift according to claim 28, further comprising a lower limit switch for limiting downward travel of the platform by interrupting power to the motor when the switch is actuated.

42. The platform lift according to claim 41, wherein the lower limit switch is actuated by a detection of slack in the lift lines.

43. The platform lift according to claim 42, wherein the lower limit switch is actuated by pressure being exerted on the safety shield.

44. The platform lift according to claim 28, further comprising a safety shield.

45. The platform lift according to claim 28, further comprising a power source for the motor.

46. The platform lift according to claim 45, wherein the power source comprises a battery.

47. The platform lift according to claim 46, wherein the battery is rechargeable.

48. The platform lift according to claim 28, wherein the motor is a direct current motor.

* * * * *